United States Patent [19]

Brown, III et al.

[11] Patent Number: 4,789,257

[45] Date of Patent: Dec. 6, 1988

[54] LINE FIND FEATURE FOR AN ELECTRONIC TYPEWRITER

[75] Inventors: John K. Brown, III, Lexington; Darell D. Cronch, Georgetown; Patricia A. Graham; Kevin N. Tucker, both of Lexington, all of Ky.

[73] Assignee: International Business Machines Corporation, Armonk, N.Y.

[21] Appl. No.: 101,044

[22] Filed: Sep. 25, 1987

[51] Int. Cl.[4] ..... B41J 11/44

[52] U.S. Cl. ..... 400/582; 400/76; 400/551; 400/508; 400/904

[58] Field of Search ..... 400/76, 551, 555, 582, 400/583, 904

[56] References Cited

U.S. PATENT DOCUMENTS

| | | | |
|---|---|---|---|
| 4,085,837 | 4/1978 | Takano et al. | 400/583 |
| 4,227,644 | 10/1980 | Sakano | 400/580 |
| 4,606,664 | 8/1986 | Pascoe | 400/904 |
| 4,618,275 | 10/1986 | Brinkman et al. | 400/76 |

OTHER PUBLICATIONS

"Vertical Paper Move . . . ", IBM Technical Disclosure Bulletin, vol. 24, No. 6, p. 2561, Nov. 86.

"Software Simulation . . . ", IBM Technical Disclosure Bulletin, vol. 28, No. 12, pp. 5350–5351, May 86.

*Primary Examiner*—William Pieprz

*Attorney, Agent, or Firm*—Laurence R. Letson

[57] ABSTRACT

A function for an electronic typewriter is described which allows the operator of the typewriter to realign the print element of the typewriter to the prior adjacent, or the following adjacent line which contains textual material, even when the present position of the print element is other than a uniform line feed increment or multiple thereof, from the designated destination line. The electronic controls of the typewriter determine the present position of the print element and the vertical location of the line to which the print element is to move, and determines the distance and moves the record sheet to position the print element precisely over the designated line of text.

11 Claims, 3 Drawing Sheets

LINE FIND FEATURE FOR AN ELECTRONIC TYPEWRITER

This invention relates to electronic typewriter functions and to a function for automatically finding and aligning the print point with the preceding or following adjacent line of text on a record sheet.

BACKGROUND OF THE INVENTION

Electronic typewriters commonly now have keyboard controlled line feed and half index up and half index down capability. Several such typewriters have micro index up and down, also. These controls allow the typist to move the paper or record sheet up or down with respect to the print mechanism, with varying increments of distance and to align the typed text to a form or to provide other non-standard index increments between the lines of text.

Clearly, this provides the typist with greatly increased flexibility and control over typewriters without such capabilities.

Unfortunately, when dealing in increments as small as 1/48th of an inch (0.529 mm), or about ⅛th of the height of the typical typed uppercase letter, the realignment of the print point at a desired point on the page or record sheet becomes difficult and the operator must guess how many such small increments are to be inserted. Parallax complicates this problem, due to different eye level positions of different operators. Without accurate realignment, it is very difficult to correct errors and position inconspicuous insertions.

Most electronic typewriters available in the market at this time reflect no attempt to address the need to accurately and automatically position the print point over a previously typed line, except to provide a reverse index feature which only reverse feeds the record sheet by the selected line feed increment, or by a fixed amount, such as a single line feed, half line feed, or micro index. Clearly if the line position is other than on a standard line feed increment or multiple thereof from the line to be aligned, the print point will not be properly positioned.

At least one commercially available electronic typewriter has the capability of storing the selected line feed, (single, double or triple space) and then when a "previous line" command is keyed, the platen drive reverse feeds the record sheet by the selected amount. The typewriter will not accommodate any deviation of the position of the print mechanism from the regularly spaced lines, and if a partial line adjustment had been made to the print mechanism position, the partial line adjustment is perpetuated in any effort to realign with a previous line. The typewriter does not have the capability of finding a subsequent or following line, and does not determine the position of a line of text in order to align the print mechanism therewith.

It is therefore an advantage of this invention that the print point of the typewriter can be positioned over one of the adjacent print lines having text, in response to a keyboard command.

Another advantage of this invention is the elimination of errors associated with attempting to position the print point of a typewriter over the text in a previously typed line of text, resulting from the misjudgment as to the print point position and from the line of text being displaced by a distance other than a standard line feed increment.

SUMMARY OF THE INVENTION

The disclosed invention permits an operator to realign the print point of an electronic typewriter with either the immediately preceding or immediately following line of text on the record sheet. The alignment is accomplished even though the record sheet has been incremented in an amount other than a standard line index distance. The electronic control of the typewriter stores data in a memory every time a new line of text is begun. The data stored includes among other things, a number representative of the distance of the new line from a datum point on the record sheet. This number is stored as the number of stepper motor steps that are necessary to move to that point from the datum point. The electronics, on command from the keyboard to move the print point to the next adjacent print line with text, will retrieve the print line location data and determine the distance differential from the present print point location, and use the distance differential expressed in stepper motor steps as the basis for a command to move the paper the required distance to position the print mechanism over the print line selected.

The electronic controls then command the paper movement to accomplish the keyboarded command.

This described feature is particularly helpful when editing or correcting a document where there has been substantial white space left in the document to permit later insertion to other materials, or where text has been typed in mixed pitch where some of the text has been typed with a 6 lines per inch paper feed and other portions of the text using a pitch with 8 lines per inch paper feed.

A better understanding of the invention may be had by referring to the drawings and the detailed description of the invention to follow.

DRAWINGS

DETAILED DESCRIPTION OF THE INVENTION

Figure 1:
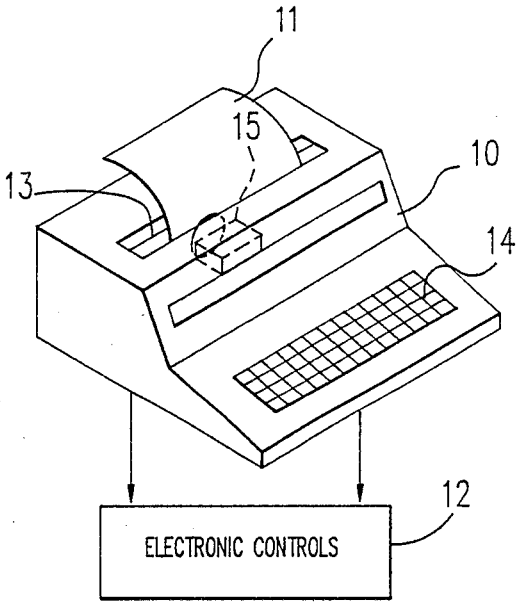
FIG. 1 is a block diagram of the electronic typewriter.

Referring to FIG. 1, the electronic typewriter 10 is illustrated with the electronic controls 12 shown as a block exterior to the typewriter 10. The electronic controls 12 receive electronic signals from the keyboard 14 and send electronic control signals to the typewriter 10 to cause it perform the functions that have been designated at the keyboard 14, such as print a character, carriage return, tabulate, correct a character or line feed. Platen 13 supports record sheet 11 for movement in the line feed direction.

Figure 2:
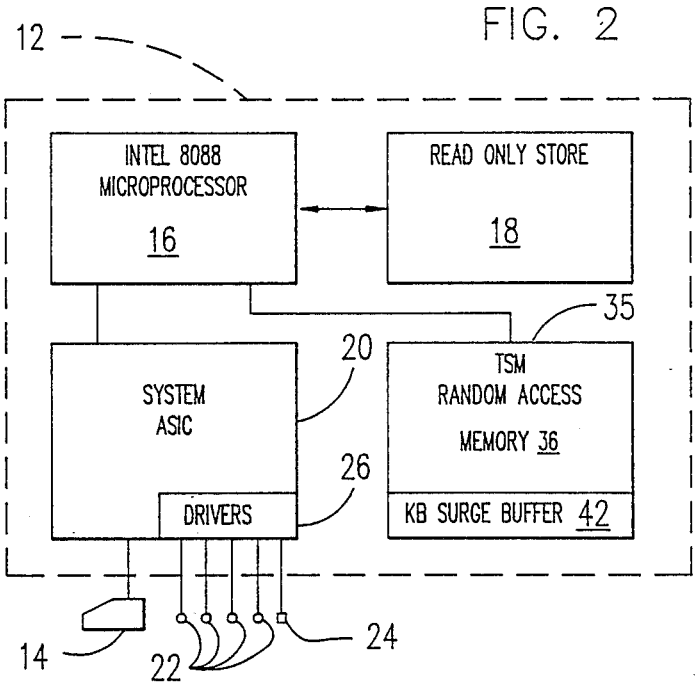
FIG. 2 is a block diagram of the electronic controls of the typewriter.

For a better understanding of the electronic controls 12, refer to FIG. 2. Electronic controls 12 are displayed as four blocks, a microprocessor 16, a Read Only Store 18, a bank of status registers-44 shown in FIG. 3 and a system ASIC or Application Specific Integrated Circuit 20, and memory 35.

The microprocessor 16 may be any of a number of commercially available microprocessors. The preferred microprocessor, chosen for this description, is the Intel 8088. One skilled in the art will recognize that this is a general purpose microprocessor for which other processors may be substituted. The microprocessor 16 is controlled by supplying to it software instructions in the form specified by the manufacturer. These instructions constitute a control program which is stored in a suitable memory such as the Read Only Store 18. The Read Only Store memory 18 is loaded with the instructions at the time of manufacture and contains the set of instructions necessary to make the typewriter 10 function as desired.

The system ASIC 20 is a standard set of AND, OR and other logic elements which may be customized as the user desires, specifically in this device to scan the keyboard 14 and control the signals from the keyboard 14. The ASIC 20 also controls the interrupts to the processor 16 and captures the keyboard signals until they are used by the processor 16. Also the ASIC 20 controls the signals from the processor 16 and directs the processor output signals to a set of driver circuits 26 which convert the processor signals into signals that can be used to drive motors 22 and magnet 24.

The specific combination of the discrete logic elements in the ASIC 20 is designed to provide a number of functions and signals. Some of the signals and functions provided are the keyboard scan to detect any newly depressed keys, interrupts of the processor 16 to cause the processor to accept a signal and the timing of signals sent to the drivers 26 so that the motors 22 and magnet 24 of the typewriter operate in the proper time frame and sequence.

The keyboard scan function, timer operation, interrupt operation and other functions of the ASIC 20 are all found essentially in commercially available keyboards or discrete components and perform the same operation. The ASIC 20 only serves to consolidate all such operations on a single chip and thus economize in space as well as cost.

Figure 3:
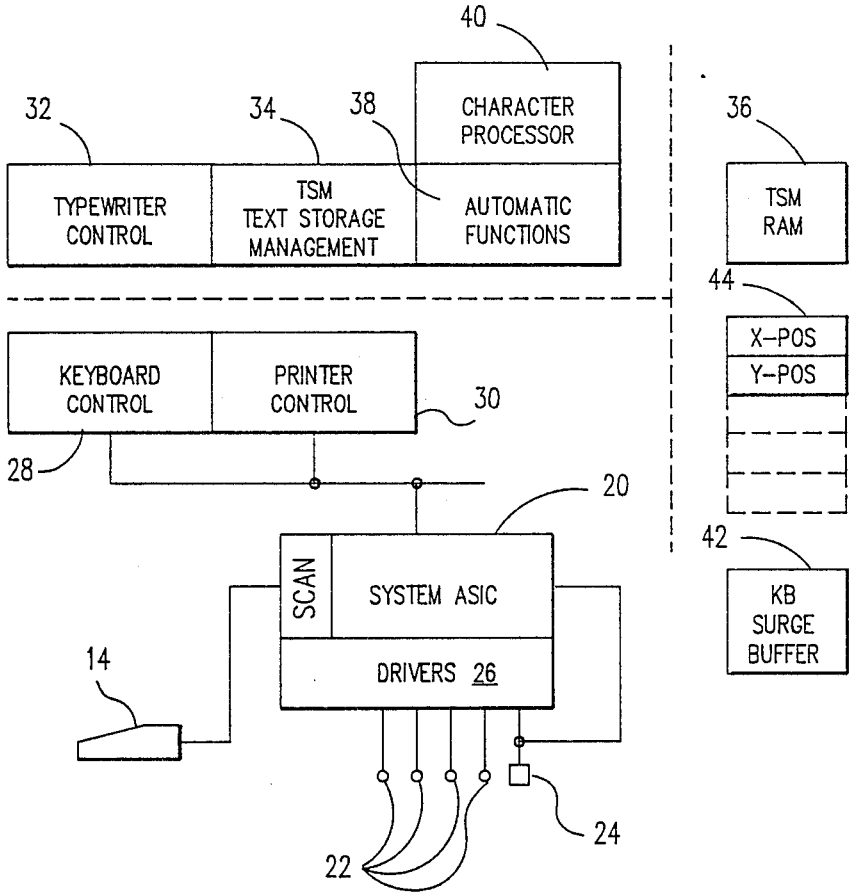
FIG. 3 is a block diagram of the functional relation of the microprocessor with the software and the keyboard, motors, magnet, and memories of the typewriter.

To further expand the description of the feature, FIG. 3 illustrates an expanded functional representation of the microprocessor 16 and its associated software. The software may be prepared by any programmer of ordinary skill in the art and may take any number of forms, any of which will adequately perform the functions of controlling the typewriter 10.

The ASIC 20 is connected to the processor 16 and is responsive to the keyboard control 28. The ASIC 20 scans the keyboard 14 and interrupts the microprocessor 16 when the ASIC 20 detects a key state change. The keyboard control 28 causes the storage of the keystrokes from the keyboard in the keyboard surge buffer 42 until the typewriter control 32 is ready to work on the keyboard scan data.

The printer control segment 30 generates and sends the signals that are needed to operate the printer to the ASIC 20 so that the signals may be properly sequenced and timer controlled.

The typewriter control 32 serves to accept the keyboard data from the keyboard control 28 whenever the processor 16 is available to process textual data and acts to determine whether the keyboard data is representative of the alphanumeric symbols that are to be printed or representative of the functions that may be keyboard controlled. The typewriter control 32 utilizes the capabilities of the Keyboard Control segment 28 to retrieve the stored scan codes from the keyboard surge buffer 42.

To manipulate the text in storage 36 and retrieve the text, the Text Storage Management segment 34 (TSM) controls the storage of text and the necessary other codes that facilitate the efficient operation of the Random Access Memory 36. The Random Access Memory 36 is the repository of the stored code containing the text. When Character Processor 40 indicates a need for a new line for text the TSM 34 utilizes the contents of the status registers 44, which contain the location of the print mechanism, relative to the record sheet 11, to build the line header and store it in the memory 36.

In order to perform functions automatically in response to keyboard commands, the Automatic Functions segment 38 is responsible for the controlling of those functions which are performed by the typewriter 10, and which are not character processing operations. The output signals of the Automatic Functions segment 38 pass to the printer control segment 30 where the signals are processed to generate the precise control signals necessary to control the motors 22 of the typewriter 10.

To identify, select and print characters and escape the print mechanism 15, along a line to be printed, the Character Processor segment 40 has the dedicated purpose of receiving those codes from the typewriter control segment 32 that represent the characters or other symbols that are to be printed on the record sheet 11. The Character Processor segment 40 receives a decoded scan output of the keyboard 14 and determines if it is printable in the desired location. The Character Processor segment 40 is also responsible for storing the character codes in a correction buffer which is part of the TSM Random Access Memory 36.

The Character Processor 40 passes the printable character code to the Printer Control segment 30 which then, based on the data received, determines the specific motors 22, numbers of pulses, direction, and current levels to the motors 22 and magnet 24 that are required to properly print the symbol on the record sheet 11.

A keyboard surge buffer 42 is provided so that in the event that keyboard scan data is received by the system ASIC 20 at a higher rate than the system can or does utilize the key strokes the scan data will not be lost to the keyboard control 28.

The illustration of the different segments of the operations are schematically illustrated as dedicated functional blocks of the processor 16 with the software instructions stored in the Read Only Storage 18 interacting with the processor 16 to perform the necessary data processing and produce the output signals required to control the typewriter 10 to either perform a function or to print a symbol at the desired location on the record sheet 11. Thus FIG. 3 is a functional diagram expressed in both hardware and a combination of hardware and software.

When a record sheet 11 is inserted in the typewriter 10, the first typing line is designated in the processor as the datum line from which all other lines of typing are positioned and the locations of those lines are determined in terms of the number of stepper motor steps necessary to drive the platen 13 and the record sheet the requisite distance to position the print mechanism 15 of the typewriter 10 over the print line. The datum line location is set at a count of 1000. For typewriters having a micro index feature the line position is important since the operator may move the position of the print mechanism 15 relative to the record sheet 11 by an increment of about one eighth of the line feed increment. This equates to four stepper motor steps for a preferred implementation.

When the operator makes the adjustments as described above, to the line position, and then wishes to return to proper alignment with another line, such a small offset may go unnoticed, resulting in misaligned insertions, difficulty with automatic correction or poor quality corrections.

After the operator performs a carrier return or index function and keys a character, the vertical position of the print point on the record sheet 11 is stored in the Random Access Memory 36, under the control of the Automatic Functions segment 38 or Character Processor 40 using the Text Storage Management (TSM) segment 34. The position stored is determined from the Y position register of the machine status registers 44. This and other status registers maintain values indicative of the print mechanism position and other conditions of the typewriter 10.

As text is keyed at the keyboard 14, the scan data is passed thru the ASIC 20, Keyboard Control 28, decoded and then to the Typewriter Control 32 to the TSM 34. The TSM 34 will then cause to be stored in the TSM Random Access Memory 36, a block of data known as a line header. The line header contains several pieces of data which record the vertical distance from the datum line, the starting distance from the left limit of travel for the print mechanism 15 and other data which is not relevant to this invention. The piece of data with which the line find function will be concerned will be the line position count relative to the datum line position count, representative of the vertical or Y position of the print line on the record sheet 11.

Figure 4:
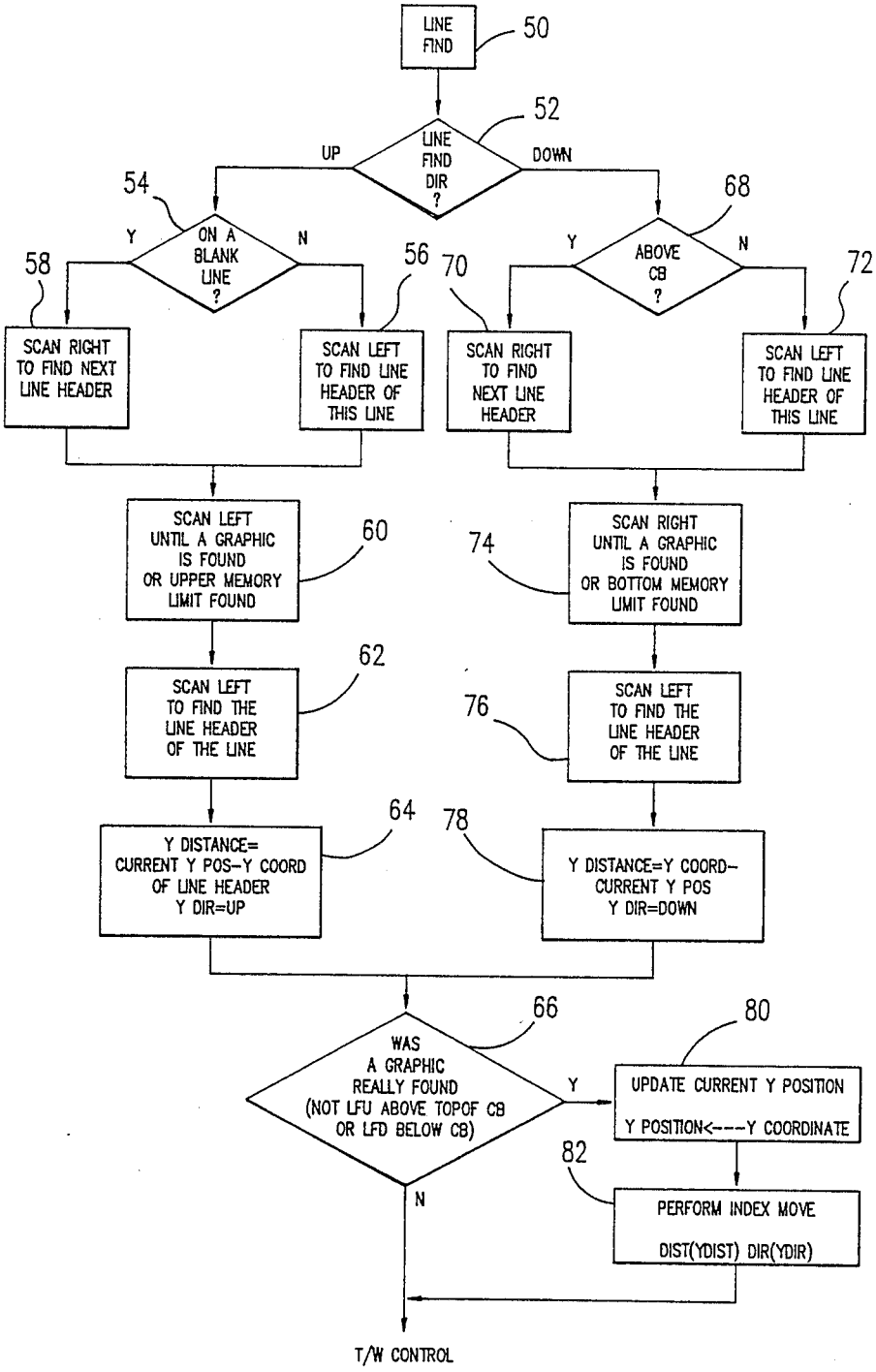
FIG. 4 is a flow diagram of the operations performed by the electronic controls of the typewriter.

With this general understanding of the operations of the typewriter, a more detailed explanation of the line find feature and its operation will follow while referring to the flow diagram in FIG. 4. The line find feature can be implemented on any electronic typewriter with sufficient memory capacity and micro-index drive of the platen, albeit at the expense of deleting other functions if adequate memory capacity does not exist. The precise workings of the microprocessor are not critical to understanding the invention since the flow diagram of FIG. 4 is general enough to provide a teaching relating to microprocessors in general.

When the operator wishes to return the print mechanism 15 to alignment with a preceding or subsequent adjacent line which has previously had text or symbols typed thereon, the operator keys this command at the keyboard. The preferred key command may be a code key and an up or down arrow, combined. Thus the operator selects the function and the direction. The key strokes are detected by the ASIC 20 on the next keyboard scan operation. The detected scan code is transmitted to the keyboard control segment 28 and inserted into the keyboard surge buffer 42. As soon as the microprocessor 16 is available to process the command, the keyboard control 28 retrieves the scan code from the surge buffer 42 and decodes the scan code and determines that the code represents a function command. The keyboard control 28 sends the scan code and a signal denoting that the accompanying scan code is a function command, to the typewriter control 32 which decodes the scan code and invokes the automatic functions segment 38 of the processor 16 and the software instructions stored in the Read Only Storage 18, and in this instance, specifically the line find routine.

When the line find routine is invoked, it is entered at entry point 50, in FIG. 4. After entry, the flow branches depending upon the direction the operator indicated, at decision point 52. The terminology blank line is used to connote that the print mechanism has been moved from a line of text to some position which is not a line of text but which is followed and preceded by lines for which line headers have been defined. A decision is then made, at decision point 54, as to whether or not the print mechanism 15 in FIG. 1 is positioned over a blank line. If the answer is NO, indicating that line occupied has had a line header defined for it, then the memory 36 is scanned to the left, at operation 56, in search of the line header for that line, which defines, among other things, the vertical position relative to the record sheet 11 of that text line.

If the decision at operation 54 is affirmative, indicating that the print mechanism 15 occupies a line for which no line header has been defined and stored, then the next action is to scan right in the memory to find next line header at operation 58.

With the termination of the scans of operation 56 or 58, the memory is scanned to the left until a symbol code (a code representing any letter or graphic character) or the upper memory limit is found, in operation 60. The symbol code is to the left of the header just found and therefore resides in a line which is before or above the position of the print mechanism 15. Finding a code for upper memory limit simply causes termination of the attempted line find since data for a higher line is not in memory. Once the scan has located a symbol code, the line may be used to align the print mechanism 15 and its relative location to the datum line must be determined. This is accomplished by scanning, as in operation 62, to the left to find the line header for the line having the symbol code just found.

With the Y coordinate, the relative vertical distance from the datum line, obtained from the line header for the line having a symbol found in operation 62, and the Y position of the print mechanism as maintained in the status registers 44, the Y or vertical distance that must be traversed to properly position the print mechanism 15 at the desired line of text on the paper, is calculated in operation 64. The tow values are expressed in numbers or increments corresponding to stepper motor steps and are subtracted.

As an additional check in operation 66 so that the alignment will occur on a line with text thereon, a determination is made that a symbol was in fact found in operation 60 to thereby eliminate the conditions: (1) a line find up (LFU) operation being executed when the print mechanism 15 is already above the text on the record sheet 11 and the corresponding point in memory is left of the correction memory contents; (2) a line find down (LFD) command being executed when the print mechanism 15 is below the last text on the record sheet 11, and the corresponding point in memory is to the right of all text in the memory; or, (3) a line find up or down command which causes a scan of data in which that several line headers exist with no associated graphics at all. These checks assures that there is in fact a line containing text to which the print mechanism 15 may be moved, in response to the command from the keyboard 14.

Referring back to the operation of determining the direction of the line find command in operation 52, if the direction is determined to be down, then it is determined, in operation 68, if the point in the memory corresponding to the position of the print mechanism 15, is above any the text stored in the correction memory or buffer 36. If that decision, at operation 68, is in the affirmative, then a scan to the right to find the next line header is initiated in operation 70.

If the decision in operation 68 is in the negative, then the scan is initiated to the left to find the next previous line header, in operation 72. The scan of operation 70 and 72 acts to find a known point in the memory at the beginning of a non-blank line. After the scan in operation 70 or 72 has been completed, a scan to the right from that point is initiated and maintained until a symbol code is found or until the bottom memory limit is found, in operation 74. This either finds a line with a symbol therein or exits this operation without being dead-ended.

The location of the line in which a symbol was found is determined by the scanning to the left from the point of the symbol until the line header for that line is found, in operation 76. This will provide, among other things, the Y coordinate of the line to which the print mechanism 15 will be relatively moved, by the driving of the record sheet.

The distance, through which the record sheet must be moved, can now be determined in operation 78 where the location of the print mechanism 15, relative to the datum line, is subtracted from the Y coordinate of the line to which the print mechanism 15 is to be aligned. This will yield the Y distance to be moved.

Upon the completion of operation 78 the same operation 66 as described earlier is performed to verify that a symbol code was in fact located during the scan operation 74.

If no symbol code was located as a result of the scans in operation 60 or operation 74 there is no line with text therein which is in the direction indicated by the operator, with which the print mechanism 15 can align and the data flow is directed to return to the control of the typewriter control segment 32 in FIG. 3. On the other hand, if a symbol code was found in the scan of operation 60 or 74, then there exists a line of text with which the print mechanism 15 may align and the flow branches to operation 80 where the current Y position in the status registers is updated to reflect the value of the Y coordinate.

Following the update procedure in operation 80, the index move of operation 82 is performed by sending the necessary commands and the distance to be moved to the printer control segment 30. The printer control segment 30 receives the index or reverse index command, and the distance, determined in operations 64 or 78 and determines the particular motors and directions of drive. This information and the distance are then used to control the number of drive pulses that are to be sent to the selected drive stepper motor and the polarity of the pulses. The result is the platen 13 being driven in the desired direction by the desired distance to position the print mechanism 15 precisely over the next adjacent print line having text therein, in the operator selected direction.

The operation of the invention, although explained in conjunction with the drawings, is in summary as follows: The operator commences the operation of the function, by keying a command at the keyboard 14 which identifies the command and the direction of movement. The microprocessor 16 of the typewriter processes the command and determines the direction of desired movement. Then the microprocessor determines a known point in memory and scans to locate a line of text which contains a symbol which is the next adjacent line of text to the location of the print mechanism 15, in the desired direction. The location of that line is determined and the distance to be moved is determined. A double check that a symbol had been found is accomplished to eliminate the possibility that the print mechanism was located outside the boundaries of the stored text segment in the correction memory. After verifying the existence of the symbol within a line of text, the microprocessor, under the control of the software, issues commands in the form of signals to drive the stepper motor or motors 22 and thereby move the record sheet 11 to the desired position.

The flow diagram of FIG. 4 and the general discussion of the microprocessor 16 provide, to a programmer of ordinary skill in the art, the necessary information for a detailed program of instructions to be written for the control of a typewriter and providing to that typewriter the line find function. The program listing may be written for any number of microprocessors that are available commercially and each will vary due to the need for different commands for each processor. The disclosure herein is made with specific reference to an Intel 8088 microprocessor; however, this is only the preferred embodiment, not to be considered as the only possible embodiment.

While only one embodiment is shown and described, other embodiments are possible and these will be apparent to one of ordinary skill wishing to implement the invention.

We claim:

1. An electronic typewriter comprising:

a keyboard for generating signals representative of typewriter functions and symbols;

a print means for printing said symbols on a record sheet;

record sheet support means;

record sheet feed means for driving said record sheet;

electronic control means responsive to said keyboard signals, comprising: memory for storing electrical codes which represent said symbols, electrical codes representing said typewriter functions and electrical codes representing the position, relative to said record sheet, occupied by a line of text having said symbols therein;

reading and decoding means for reading and decoding said codes representing the position of a line of text on said record sheet; and move control means responsive to said keyboard and said electronic control means for comparing relative positions of said print means and a selected one of said lines having text thereon as determined by said reading and decoding means, relative to said record sheet, and for commanding said record sheet feed means to move said record sheet by the necessary distance to align only said selected line having text thereon with said print means, thereby aligning the print means with the selected line having text thereon, with regard only to the exact distance between the print means and the selected line having text thereon.

2. The typewriter of claim 1 wherein said keyboard comprises means for selection of said selected line having text thereon.

3. The electronic typewriter of claim 2 wherein said means for selection comprises means for designating a line having text thereon, immediately preceding or immediately following the position of said print means.

4. The electronic typewriter of claim 1 wherein said electrical code representing the position of a line having text thereon, comprises a code representing a distance relative to the top of said record sheet to the position of the line of text associated with that electrical code representing position.

5. The electronic typewriter of claim 1 wherein said electrical code representing the position of a line having text thereon, comprises a code representing a distance relative to a first line of text, to the position of the line of text associated with that electrical code representing position.

6. The typewriter of claim 1 further comprising means to verify, as a condition of said aligning, that symbols are contained in said selected line.

7. The typewriter of claim 2 further comprising means to verify, as a condition of said aligning, that symbols are contained in said selected line.

8. The typewriter of claim 3 further comprising means to verify, as a condition of said aligning, that symbols are contained in said selected line.

9. The typewriter of claim 4 further comprising means to verify, as a condition of said aligning, that symbols are contained in said selected line.

10. The typewriter of claim 5 further comprising means to verify, as a condition of said aligning, that symbols are contained in said selected line.

11. An electronic typewriter comprising:

a keyboard for generating signals representative of typewriter functions and symbols;

a print means for printing said symbols on a record sheet;

record sheet support means;

record sheet feed means for driving said record sheet;

electronic control means responsive to said keyboard signals, comprising:

memory for storing electrical codes which represent said symbols, electrical codes representing said typewriter functions and electrical codes representing the position, relative to said record sheet, occupied by a line of text having said symbols therein;

means responsive to a line realignment command, having a directional component, from said keyboard to electronically search said memory in the direction of movement indicated by said line move entry to determine the existence of a line with a symbol, in said direction of movement;

means to terminate an attempt to respond to said line realignment command when said search indicates no existence of said line with a symbol;

means to electronically search data related to said line with a symbol, when said search indicates said line with a symbol, to obtain location information from said data related to said line with a symbol; and means for computing the necessary move distance of said record sheet, from said location information and from the current position of said print means to align said print means with said line with a symbol according to the exact distance between said print means and said line with a symbol.

* * * * *